United States Patent [19]

Balzer

[11] Patent Number: 4,757,952

[45] Date of Patent: Jul. 19, 1988

[54] METHOD AND DEVICE FOR WINDING TOGETHER INDIVIDUAL ARTICLES OF A FLEXIBLE MATERIAL

[76] Inventor: Peter Balzer, Bahnhofstr. 715, 8197 Rafz, Switzerland

[21] Appl. No.: 845,525

[22] Filed: Mar. 28, 1986

[30] Foreign Application Priority Data

Sep. 13, 1984 [CH] Switzerland ..... PCT/CH84/00145

[51] Int. Cl.[4] ..... B65H 18/22

[52] U.S. Cl. ..... 242/67.1 R; 242/75.1

[58] Field of Search ..... 242/55, 67.1 R, 65, 242/66, 75.1, 192

[56] References Cited

U.S. PATENT DOCUMENTS

| | | | |
|---|---|---|---|
| 4,114,530 | 9/1978 | Miller | 242/67.1 R |
| 4,164,177 | 8/1979 | Canfield | 242/55 |
| 4,389,868 | 6/1983 | Strout | 242/56 R X |

FOREIGN PATENT DOCUMENTS

| | | |
|---|---|---|
| 95790 | 12/1983 | European Pat. Off. . |
| 2516226 | 10/1976 | Fed. Rep. of Germany . |
| 1207049 | 2/1960 | France . |
| 2157537 | 6/1973 | France . |
| 2436736 | 4/1980 | France . |
| 2096973 | 10/1982 | United Kingdom . |

*Primary Examiner*—David Werner

*Attorney, Agent, or Firm*—Antonelli, Terry & Wands

[57] ABSTRACT

A method and apparatus for winding individual articles of flexible material together around a winding axis, wherein at least one endlessly rotating belt contacts the winding axis over a large portion of its circumference. A portion of the belt forms a feed plane for feeding the individual articles to the winding axis. The feed plane is held at a constant position and feeds the individual articles tangentially to the winding axis, regardless of the radius of the winding axis.

17 Claims, 2 Drawing Sheets

METHOD AND DEVICE FOR WINDING TOGETHER INDIVIDUAL ARTICLES OF A FLEXIBLE MATERIAL

The present invention relates to a method for winding individual articles of flexible material together around a winding axis wherein at least one endlessly rotating belt contacts material which has been wound over a large portion of the circumference of the wound material and wherein the individual articles are supplied immediately before the wound material along a feed path formed by the belt in a feed plane. The present invention further relates to a device for winding individual articles of flexible material together around a winding axis which includes an endlessly rotating belt arrangement which contacts material which has been wound over a large portion of the circumference of the wound material and to which the individual articles are fed to the wound material along a feed plane.

French Pat. No. 1,207,049 describes a method in which an endlessly rotating belt is provided for winding individual articles of flexible material together, wherein the belt contacts the wound material during its formation. The endlessly rotating belt also serves as a means of supplying the individual articles to the wound material along a feed path. The feed path is provided by the endlessly rotating belt passing over a plurality of guide rollers and becomes a feed plane in a portion just prior to entering the winding area. In one embodiment, a pressure roller cooperates with the wound material, and the feed plane of the feed path passes between the wound material and the pressure roller. Further, the axis of the wound material is displaceably mounted to accept progressively increasing radius of the wound material. The feed plane remains at a constant position in relation to the wound material while the radius of the wound material is constantly changing. Therefore, the angle at which the feed plane supplies the material to be wound changes and the feed conditions from the feed plane to the wound material constantly change with increasing winding radius, so that the feed plane is tangential to the wound material only at a specific winding radius. This is extraordinarily disadvantageous for the winding of highly flexible material such as, for example, plastic film, because the feed area to the wound material is of substantial importance for continuous, frictionless rolling of individual articles of flexible material.

In a further embodiment of French Pat. No. 1,207,049, the feed plane always remains in a tangential plane to the wound material, regardless of the changing radius of the wound material. However, the feed path for the individual articles is diverted just before entering the winding area, depending on the instantaneous radius of the wound material, and the slope of the feed plane changes. This raises disadvantages in the feed area and in rolling of the individual articles.

One objective of the present invention is to provide a method in which there are constant feed conditions for the individual articles independent of the instantaneous radius of the wound material.

This object of the present invention may be achieved by keeping the feed plane of the individual articles at a constant tangential position to the wound material, regardless of the winding radius.

In one embodiment of the present invention an endlessly rotating belt is driven in known fashion by a drive roller arrangement, while the belt acts to drive the wound material. The drive roller arrangement is positioned so that a plane connecting the central axis of the drive roller arrangement with the winding axis of the wound material forms a substantial right angle with the feed plane regardless of the winding radius. Preferably, the angle between the planes is exactly a right angle.

A further disadvantage of the methods found in the prior art such as French Pat. No. 1,207,049 is that the wound material is normally wound on winding cores that remain in or are later withdrawn from the finished wound material, or is wound by means of gripper arbors, which grip each side of the front of a first individual article to be wound, and roll it up. These cores or arbors increase the cost of the finished wound material as either additional consumable material or in higher machine production expense. It is desirable to have as few elements as possible act on the individual articles during the process, to avoid the additional costs and disadvantages. In order to overcome the disadvantages in using cores or arbors French Pat. No. 1,207,049 proposes that the axis of the wound material be fixed by specifying an initial minimal belt wrap which allows the first individual article of material to be wound without using additional elements and then act as the winding axis for subsequent individual articles.

SUMMARY OF THE PRESENT INVENTION

The present invention relates to a device for winding individual articles of windable flexible material around a winding axis using an endlessly rotating belt arrangement which contacts material that has been wound over a large portion of the circumference of the wound material, and to which the individual articles are fed to the wound material along a feed plane. The present invention achieves the advantages discussed above by providing the feed plane in a position tangential to the wound material in the feed area of the individual articles independent of the winding radius of the wound material.

In one embodiment of the present invention, a drive roller arrangement is provided for driving the belt with the drive roller arrangement positioned so that a plane connecting the winding axis of the wound material and the central axis of the drive roller arrangement is substantially perpendicular to the feed plane. Preferably, the planes are exactly perpendicular. In a further embodiment of the present invention, winding is performed without the use of cores or arbors, by determining the winding axis by a specified initial minimal wrap of the endlessly rotating belt. This is accomplished by designing the endlessly rotating belt to extend beyond the wound material on at least one side, and by providing a pin arrangement which projects against the wound material on the same side which determines the initial minimum wrap with no wound material in place.

DETAILED DESCRIPTION OF THE DRAWINGS

Figure 1:
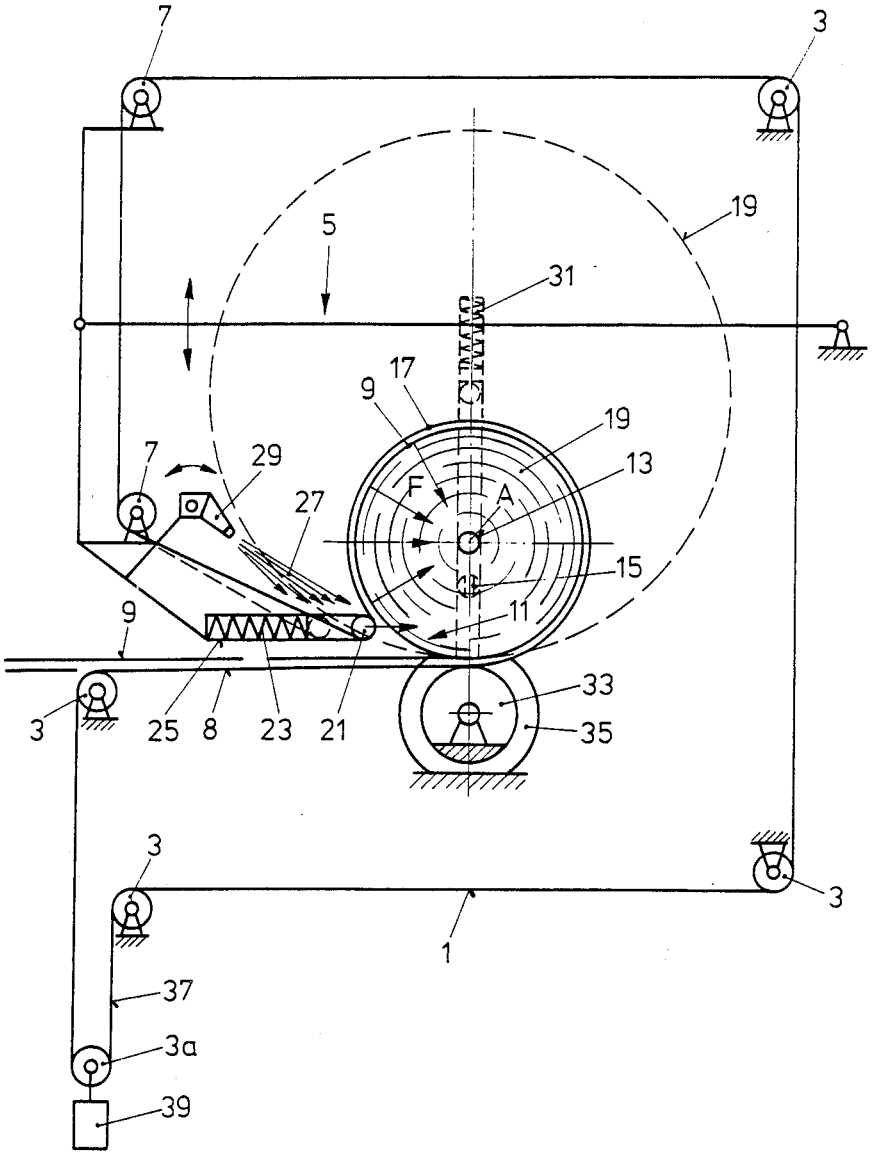
FIG. 1 is a schematic side view of a device according to the present invention that operates according to the method of the present invention.

Referring to the drawings, wherein like reference numerals are used throughout the various views to designate like parts and, more particularly, to FIG. 1 which shows an endless belt 1 that rotates around fixed guide rollers 3 and around a tilting mechanism 5 shown schematically of guide roller 7 that can pivot upward. A portion of endless belt 1 is feed plane 8, on which individual articles 9 to be wound are placed. Feed plane 8 runs with individual articles 9 into a winding feed area 11. To perform the winding of the individual articles, a core 13 or a pair of lateral gripper arbors 15, shown as dashed lines, is provided. A first individual article to be wound is either rolled around core 13, or is gripped laterally by gripper arbor 15 and likewise rolled up. Another portion of endless belt 1 is a wrap area 17, which contacts a large portion of the circumference of wound material 19, and which is changing in length as individual articles 9 are wound in succession. At the end of wrap area 17, endless belt 1 is lifted from the wound material at an acute angle by means of a relatively thin guide shaft 21 which is pressed against the instantaneous outer surface of wound material 19 by means of a spring 23. Spring 23 together with guide shaft 21, is guided, for example, parallel to feed plane 8 in such a way that shaft 21 never comes into contact with individual articles 9. Guide shaft 21 can either be a shaft supported to rotate or a guide rod made of suitable material such as, for example, Teflon, to keep frictional losses and wear as low as possible. Spring 23 is positioned in appropriate bushings 25 forming counter-bearings on both sides of guide shaft 21. The arrangement bushings 25, spring 23 and guide shaft 21 can be tilted with tilting mechanism 5 in order to withdraw finished wound material and when winding on a core, to insert a new core 13 or to ensure that the first individual article to be wound is gripped securely by the lateral gripper arbors 15 if provided. Instead of a guide shaft 21, pins extending into the path on both sides may be provided for guidance or a pressure jet of gas or air 27 that is formed by nozzle arrangement 29, shown schematically, may be provided for guidance. Nozzle arrangement 29 is connected to tilting mechanism 5, and is positionable as shown by the double arrow, to form as large a wrap area 17 as possible. Core 13 or the two lateral arbors 15 are movably mounted, if necessary, against the force of a spring arrangement 31 provided on one or both sides of wound material 19, perpendicular to feed plane 8. A drive roller 33, driven by, for example, an electric motor 35, lies on the extension of the path of motion of core 13 or gripper arbors 15. Feed plane 8 contacts wound material 19, tangentially and also forms a plane tangential to drive roller 33. Drive roller 33 contacts endless belt 1 along a line which, aside from separation, coincides with the outer surface of wound material 19 through a particular individual article introduced. Therefore, in accordance with the present invention, feed plane 8 is designed to remain at a constant position independent of the winding radius of wound material 19, for example, horizontally and tangentially. To ensure that there is a sufficient length of endless belt 1 available for the increasing winding radius, as shown in dashed lines, a belt reserve is provided by suspending an idler guide roller 3*a*, loaded with a weight 39, in a reserve loop 37. When an increased length of endless belt 1 is needed for wrap area 17, reserve loop 37 is reduced, with weight 39 providing the tension for the endless belt. Wrap area 17 exerts a nearly constant pressure F on the uppermost layer of individual articles of wound material 19 independent of the position of core 13 or gripper arbors 15, and in general of winding axis A. An equilibrium position attempts to become established between the forces acting at all times on the wound material 19. Winding axis A can be shifted to the left from its position in the vertical plane through the axis drive roller 33 (FIG. 2) but this does not fundamentally effect the winding process. It is possible to press guide shaft 21 against wound material 19 by its own weight, without the use of spring 23. For this purpose, a pivoting suspension of shaft 21 could be used, as indicated by dots and dashes, with the angle point either fixed or pivotable and with shaft 21 additionally guided to leave feed plane 8 open.

Figure 2:
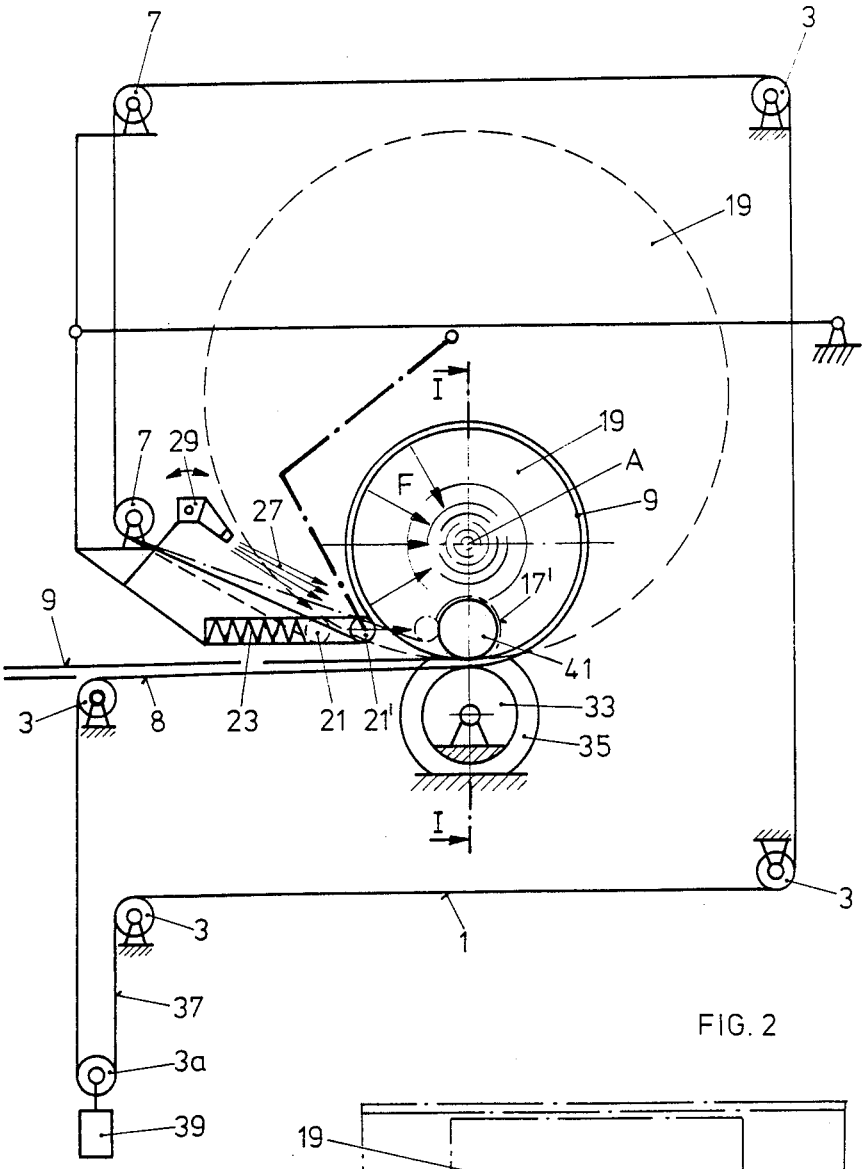
FIG. 2 is schematic side view of a device according to the present invention for coreless and arborless winding.

A device for coreless and arborless winding according to the present invention is illustrated in FIG. 2. This device is similar to that of FIG. 1 with like reference numerals used for like parts. As described above, it is desirable to wind the individual articles without providing a core or using lateral gripper arbors. After rolling the front portion of a first individual article to be wound, this first individual article forms winding axis A with its rolled-up front portion. In addition to a substantial simplification of the device and reduction of prior art disadvantages, a tighter winding is possible, and therefore more individual articles may be wound in a given winding diameter.

Figure 3:
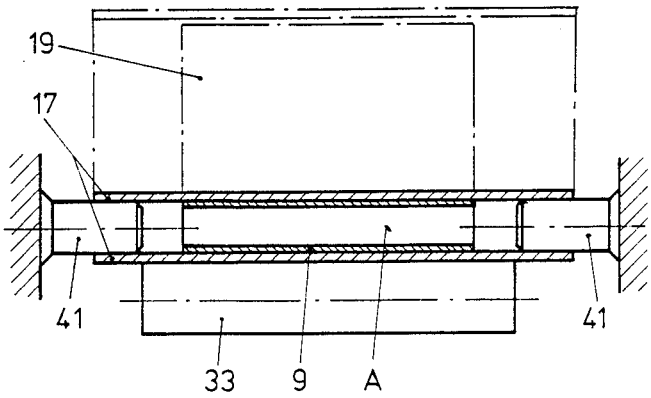
FIG. 3 is a schematic view along line I—I of FIG. 2.

According to FIGS. 2 and 3, guide pins 41 extend into an area of endless belt 1, with the endless belt 1 extending beyond at least one lateral edge and preferably both lateral edges of individual articles 9, as shown most clearly in FIG. 3. Pins 41 extend into the area of endless belt 1 but do not extend as far as the width of individual articles 9. At the beginning of the winding process according to FIG. 2, guide shaft 21 is in the position 21′ drawn in dashed lines, and rests against guide pins 41. The endless belt 1 contacts guide pins 41 without individual articles being present and is lifted from the guide pins 41 by guide shaft 21. When a first individual article 9 is fed to the winding area as can be seen most clearly in FIG. 3, it is rolled in an initial minimal loop 17′ formed by endless belt 1 around guide pins 41. The first individual article 9 does not contact the guide pins 41 and the subsequent individual articles 9 are rolled over it. The configuration with wound material 19 already formed is shown in FIG. 3 by dot-dashed lines. By using the device of the present invention, there is no longer a need for winding cores or lateral gripper arbors under precise control.

In accordance with the device and method of the present invention, it is possible to wind delicate individual articles, such as, for example, garbage bags and other finished products made of extremely flexible plastic, without the use of cores or arbors. The wound material produced can be pulled out as needed by a consumer effortlessly, one after the other, such as, for example, garbage bags to be used. The method and device of the present invention are also suitable for a number of other delicate products to be wound, such as, for example, protective covers for automobile seats made of plastic film, domestic bags, lengths of aluminum foil, lengths of domestic film, etc.

While I have shown and described several embodiments in accordance with the present invention, it is understood that the same is not limited thereto but is susceptible to numerous changes and modifications as known to one having ordinary skill in the art, and I therefore do not wish to be limited to the details shown and described therein, but intend to cover all such modifications as are encompassed by the scope of the appended claims.

I claim:

1. A method for forming a coil of individual articles of flexible material around a winding axis, comprising:

providing at least one endlessly rotating belt which initially contacts the winding axis and then contacts the coil over a large portion of their respective circumferences;

providing a feed plane along a portion of the belt; and feeding the individual articles along the feed plane initially to the winding axis and then to the coil to wind the articles together around the winding axis;

wherein the feed plane is held at a constant position and feeds the articles at a constant location tangentially initially to the winding axis and then to the coil, regardless of the radius of the coil around the winding axis.

2. A method according to claim 1, further comprising driving the belt by a drive roller arrangement and driving the winding axis by the belt, wherein the drive roller arrangement is designed so that a plane connecting an axis of the drive roller arrangement and the winding axis, forms a nearly right angle with the feed plane regardless of the radius of the coil around the winding axis.

3. A method according to claim 2, wherein the angle between the connecting plane and the feed plane is exactly a right angle.

4. A method according to claim 1, further comprising specifying an initial minimum winding axis.

5. A method according to claim 1, wherein the articles have a foil form.

6. A method according to claim 1, wherein the articles are at least one of separate garbage bags, separate automobile seat covers, lengths of aluminum foil, or domestic plastic bags.

7. An apparatus for forming a coil of individual articles of flexible material around a winding axis, comprising:

at least one endlessly rotating belt which initially contacts the winding axis and then contacts the coil over a large portion of their respective circumferences, and includes a portion which acts as a feed plane for feeding the articles initially to the winding axis and then to the coil;

wherein the feed plane is held at a constant position and feeds the articles at a constant location tangentially initially to the winding axis and then to the coil, regardless of the radius of the coil around the winding axis.

8. An apparatus according to claim 7, further comprising a drive roller arrangement for driving the belt and the belt driving the winding axis, wherein the drive roller arrangement is designed so that a plane connecting an axis of the drive roller arrangement and the winding axis forms a nearly right angle with the feed plane.

9. An apparatus according to claim 8, wherein the angle between the connecting plane and the feed plane is exactly a right angle.

10. An apparatus according to claim 7, wherein an initial minimum winding axis is specified.

11. An apparatus according to claim 10, wherein the belt extends beyond at least one side of the winding axis, and further comprising a pin arrangement which extends against at least one side of the winding axis to establish the initial minimum winding axis.

12. An apparatus according to claim 7, wherein the belt is equipped with a tensioning device.

13. An apparatus according to claim 12, wherein the tensioning device comprises at least one guide element that is connected to a force-producing element such as at least one of a weight or a spring element so as to produce a belt tension.

14. An apparatus according to claim 7, wherein the belt is lifted from the winding axis after contacting the winding axis by means of a guide element.

15. An apparatus according to claim 7, wherein the belt after contacting the winding axis is guided by at least one of a guide roller, a guide rod or a gas jet outlet device.

16. An apparatus according to claim 7, wherein the articles have a foil form.

17. An apparatus according to claim 7, wherein the articles are at least one of separate garbage bags, separate automobile seat covers, lengths of aluminum foil, or domestic plastic bags.

* * * * *